US008071522B2

(12) United States Patent
Sloan

(10) Patent No.: US 8,071,522 B2
(45) **Date of Patent: *Dec. 6, 2011**

(54) UNIVERSAL SYNTHETIC GOLF CLUB CLEANER AND PROTECTANT, METHOD AND PRODUCT-BY-PROCESS TO CLEAN, PROTECT GOLF CLUB FACES AND REJUVENATE GOLF CLUBS GRIPS

(75) Inventor: Ronald J. Sloan, Blaine, WA (US)

(73) Assignee: Bestline International Research, Inc., Schenectady, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/808,495

(22) PCT Filed: Jan. 13, 2008

(86) PCT No.: PCT/US2008/050951

§ 371 (c)(1),
(2), (4) Date: Jun. 16, 2010

(87) PCT Pub. No.: WO2009/079020

PCT Pub. Date: Jun. 25, 2009

(65) Prior Publication Data

US 2011/0009301 A1 Jan. 13, 2011

Related U.S. Application Data

(63) Continuation-in-part of application No. PCT/US2007/088252, filed on Dec. 19, 2007, which is a continuation-in-part of application No. 11/290,596, filed on Dec. 1, 2005, now Pat. No. 7,745,382.

(60) Provisional application No. 60/644,494, filed on Jan. 18, 2005.

(51) Int. Cl.
*C11D 3/20* (2006.01)

(52) U.S. Cl. ..... 510/245

(58) Field of Classification Search ..... 510/245
See application file for complete search history.

(56) References Cited

U.S. PATENT DOCUMENTS

| | | | |
|---|---|---|---|
| 3,406,419 | A | 10/1968 | Young |
| 3,984,599 | A | 10/1976 | Norton |
| 4,127,491 | A | 11/1978 | Reick |
| 4,131,551 | A | 12/1978 | Thompson et al. |
| 4,218,330 | A | 8/1980 | Shubkin |
| 4,224,173 | A | 9/1980 | Reick |
| 4,228,021 | A | 10/1980 | Lenack |
| 4,375,418 | A | 3/1983 | Zoleski et al. |
| 4,443,348 | A | 4/1984 | Wright et al. |
| 4,504,404 | A | 3/1985 | Schumacher et al. |
| 4,534,873 | A | 8/1985 | Clark |
| 4,844,825 | A | 7/1989 | Sloan |
| 4,859,359 | A | 8/1989 | DeMatteo et al. |
| 4,956,122 | A | 9/1990 | Watts et al. |
| 5,120,358 | A | 6/1992 | Pippett |
| 5,136,118 | A | 8/1992 | Buchanan et al. |
| 5,202,040 | A | 4/1993 | Sanderson et al. |
| 5,332,516 | A | 7/1994 | Stephens |
| 5,364,994 | A | 11/1994 | Scharf |
| 5,431,841 | A | 7/1995 | Lockhart |
| 5,631,211 | A | 5/1997 | Nakagawa et al. |
| 5,672,572 | A | 9/1997 | Araik et al. |
| 5,681,797 | A | 10/1997 | Lawate |
| 5,741,764 | A | 4/1998 | Patel et al. |
| 5,885,942 | A | 3/1999 | Zhang et al. |
| 5,972,853 | A | 10/1999 | Boffa et al. |
| 6,008,164 | A | 12/1999 | Aldrich et al. |
| 6,046,142 | A | 4/2000 | Zilonis et al. |
| 6,074,993 | A | 6/2000 | Waddoups et al. |
| 6,143,701 | A | 11/2000 | Boffa |
| 6,413,916 | B1 | 7/2002 | Baumgart et al. |
| 6,761,645 | B1 | 7/2004 | Weber |
| 6,774,091 | B2 | 8/2004 | Dituro et al. |
| 6,858,567 | B2 | 2/2005 | Akao |

(Continued)

FOREIGN PATENT DOCUMENTS

| | | | |
|---|---|---|---|
| DE | 19723460 | A1 | 1/1998 |
| EP | 0361180 | A1 | 4/1990 |
| EP | 0837122 | A2 | 4/1998 |
| EP | 1203803 | A1 | 5/2002 |
| EP | 1736529 | A1 | 12/2006 |
| FR | 2193080 | | 7/1972 |
| JP | 59204700 | * | 11/1984 |
| JP | 07233001 | | 9/1995 |
| JP | 2001-271077 | A | 10/2001 |
| WO | 9719153 | | 5/1997 |
| WO | 0234867 | A1 | 5/2002 |
| WO | 03064571 | A1 | 8/2003 |
| WO | 2006-015800 | A1 | 8/2005 |
| WO | 2006100188 | A1 | 9/2006 |
| WO | 2007004789 | A1 | 1/2007 |
| WO | 2009078882 | A1 | 6/2009 |
| WO | 2009079020 | A1 | 6/2009 |
| WO | 2009085957 | A1 | 7/2009 |
| WO | 2009085967 | A1 | 7/2009 |

(Continued)

OTHER PUBLICATIONS

Rudnick, Leslie R., Ed., Synthetic Mineral Oils and Bio Based Lubricants: Chemistry and Technology, Taylor & Francis (2006).

(Continued)

*Primary Examiner* — Cephia D Toomer
(74) *Attorney, Agent, or Firm* — Jay R. Yablon

(57) ABSTRACT

The club cleaner, conditioner and protectant comprises alpha-olefins, low-odor aromatic solvents; and at least one base oil selected from the base oil group consisting of Hydroisomerized high base oils and HT Severe Hydro-cracked Base oils; as well as other (optional) ingredients. Also disclosed is a method for producing this product and related product-by-process. This product uses a formulated cleaning mixture to clean and restore the face of the club while rejuvenating the grips. The invention when sprayed on the clubface removes foreign materials and when wiped dry protects the face of the clubs from harsh stains, caused by soils, grass and chemicals related to fertilizers. In experimental testing, the invention increases drive distances by reducing sidespin and increasing backspin. The club is left with a factory-like finish making it easy to wipe clean of soiling. The invention when applied to the grips restores the surface to the new feel.

43 Claims, No Drawings

U.S. PATENT DOCUMENTS

| | | | | |
|---|---|---|---|---|
| 6,919,300 | B2 | 7/2005 | Dituro | |
| 6,962,895 | B2 | 11/2005 | Scharf et al. | |
| 6,992,049 | B2 | 1/2006 | Deckman et al. | |
| 7,018,960 | B2 | 3/2006 | Negoro et al. | |
| 7,022,766 | B2 | 4/2006 | Okada et al. | |
| 7,055,534 | B2 * | 6/2006 | Goode et al. | 134/22.19 |
| 7,109,152 | B1 | 9/2006 | Corby et al. | |
| 7,124,728 | B2 | 10/2006 | Carey et al. | |
| 7,745,382 | B2 | 6/2010 | Sloan | |
| 7,931,704 | B2 | 4/2011 | Sloan | |
| 8,022,020 | B2 | 9/2011 | Sloan | |
| 8,039,424 | | 10/2011 | Sloan | |
| 2003/0040444 | A1 | 2/2003 | Garmier | |
| 2003/0087769 | A1 | 5/2003 | Dituro et al. | |
| 2004/0014613 | A1 | 1/2004 | Dituro et al. | |
| 2004/0060229 | A1 | 4/2004 | Todd et al. | |
| 2004/0077506 | A1 | 4/2004 | Arrowsmith et al. | |
| 2006/0160708 | A1 | 7/2006 | Sloan | |
| 2008/0182769 | A1 | 7/2008 | Sloan | |
| 2008/0190014 | A1 | 8/2008 | Volkel et al. | |
| 2010/0261626 | A1 | 10/2010 | Sloan | |
| 2010/0269404 | A1 | 10/2010 | Sloan | |
| 2010/0273687 | A1 | 10/2010 | Sloan | |
| 2010/0273688 | A1 | 10/2010 | Sloan | |
| 2011/0015103 | A1 | 1/2011 | Sloan | |
| 2011/0197499 | A1 | 8/2011 | Sloan | |

FOREIGN PATENT DOCUMENTS

OTHER PUBLICATIONS

Journal of Automotive Engineering, May 1, 2001, vol. 55, No. 5, pp. 67-72.

Journal of Automotive Engineering, May 1, 2001, vol. 55, No. 5, pp. 67-72, English translation of: p. 70, last paragraph; Figures 6 and 7.

* cited by examiner

UNIVERSAL SYNTHETIC GOLF CLUB CLEANER AND PROTECTANT, METHOD AND PRODUCT-BY-PROCESS TO CLEAN, PROTECT GOLF CLUB FACES AND REJUVENATE GOLF CLUBS GRIPS

This application is a 371 of PCT/US2008/050951 filed Jan. 13, 2008, which is a CIP of PCT/US2007/088252 filed Dec. 19, 2007, which is a CIP of Ser. No. 11/290,596 filed Dec. 1, 2005, now U.S. Pat. No. 7,745,382, which claims benefit of 60/644,494, filed Jan. 18, 2005.

FIELD OF THE INVENTION

This invention relates a product that cleans a golf clubface while rejuvenating the grips in a manner acceptable under the United States Golf Association (USGA) and the Royal and Ancient Golf Association (R&A) rules of golf, as well as a related method and product-by-process.

BACKGROUND OF THE INVENTION

Golf club cleaners of various types are well-known. They include various brushes, bristles and other scrubbing devices using a soap and water solution. Although these devices remove the majority of the foreign debris, they do not restore the surface to a factory-like finish nor do they leave a protective surface to the face of the club. The surface of the face of a golf club is subjected to harsh elements contained in the soil and grass. Such elements contained in the soil and grass include the residue from the chemicals used to fertilize the fairways for a more appealing look. These elements attach to the surface of the club, causing distortion, which has been shown to cause increased sidespin while reducing the backspin desired by the golfer. Further, as grips dry out and loose their suppleness, the grip can slip or twist as contact with the ball is made, causing reduced backspin and often increased sidespin; with resulting hooking or slicing.

Various documents defining the general state of the art which are not of particular relevance to the novelty or inventiveness of the present invention, include U.S. Pat. Nos. 4,472,851; 5,054,153; 5,195,743; 5,385,160; 5,404,610; 5,787,539; 6,430,770; 6,733,016; and 7,162,766.

It would be desirable to provide a formulation that will clean and restore the clubface making it resistant to the natural and foreign elements in the soil while rejuvenating the club grips to a new feel.

It is further desirable to develop a suitable method for the production of such a formulation.

SUMMARY OF THE INVENTION

Disclosed herein is a golf club cleaner, conditioner and protectant product, formulated to reduce sidespin in golfing while increasing the backspin, which can result in longer and straighter drives on the golf course. The club cleaner, conditioner and protectant comprises alpha-olefins, low-odor aromatic solvents; and at least one base oil selected from the base oil group consisting of Hydroisomerized high base oils and HT Severe Hydro-cracked Base oils; as well as other (optional) ingredients. Also disclosed is a method for producing this product and related product-by-process. The invention when sprayed on the clubface removes foreign materials and when wiped dry protects the face of the clubs from harsh stains, caused by soils, grass and chemicals related to fertilizers. In experimental testing, the invention increases drive distances by reducing sidespin and increasing backspin. The club is left with a factory-like finish making it easy to wipe clean of soiling. The invention when applied to the grips will restore the surface to the new feel.

DETAILED DESCRIPTION

The invention relates to the use of a cleaning product that will not only clean the clubface and grips but will restore and add a microscopic layer of protection imbedded into the crystalline surface of the face of the club while rejuvenating and restoring the surface of the grips. The product has utility with all types of clubs including synthetic and non-synthetic grips. The invention has been submitted to both the USGA and the R&A Golf Association under confidential terms, and it has been deemed that this product is "Permitted under the Rules of Golf," "Allowable under the Rules of Golf," and that it "Conforms to the Rules of Golf." The invention further has demonstrated soil-repellency while offering the user ease of cleaning.

Primary Ingredients

The finished product (preferred embodiment of the invention) comprises:

Alpha-Olefins: This is a primary ingredient also known as Alkenes, Polymerized, Chlorowax Liquids and Chlorinated Paraffin whose carbon chain lengths are 12 to 24 with choleric weight percentage from 21.4% to 70% with specific gravity at 25 degrees centigrade of 1.050 to 1.50 and a JQD weight percentage of HCL being from 0.20 to 0.60 maximum. The primary use for the above ingredient is for lubricant formulations, lubricant additive compounds, and extreme pressure additive formulations and for metal working compounds.

Low-Odor Aromatic Solvents: This is a primary ingredient which is a highly-refined, low toxic, low-odor solvent ideal for paints, varnishes, food grade coatings, adhesives, diluents, thinners, agrochemicals, household pesticides, spray oils and specialty chemicals. Aromatic percentage is 5% to 40% (EC-A-G04). These have a flash point of 20 to 80 degrees centigrade (ASTM D-93) and a density at 30 degrees centigrade (plus/minus) of 0.600 to 0.900 (ASTM D-4052).

Hydroisomerized High Base Oils or HT Severe Hydrocracked Base Oils: This primary ingredient is a severe hydro-cracked or hydroisomerized base oil with low or no aromatics and impurities, achieved by chemically reacting the feed stock with hydrogen (3000 P.S.I.) to reduce or remove polar compounds containing Sulphur, nitrogen and oxygen and to convert aromatic hydrocarbons to saturated cyclic hydrocarbons breaking up the heavy polycyclo-paraffin molecules to light saturated hydrocarbons. This may include fractionated oils that have been hydro-finished or hydro-polished. The base oils can be used in a host of lubricating oils, motor oils, cutting oils, food processing, pharmaceutical, industry, agriculture lubricants and extreme pressure additives. These add to the protective finish of the clubface and extended the life of the grips.

Low-Flash Mineral Spirits: Referred to as Stoddard Solvent and/or White's Spirits. This optional though very desirable ingredient is commonly used as an extraction solvent, cleaning solvent, solvent in aerosols, paints, lacquers, varnishes and paint thinners for household and commercial use and has been subjected to hydrodesulfurization solvent extraction with a mixture of saturated aliphatic and alicyclic C7-C12 with a maximum of 40%. The flash point ranges from 15 to 40 degrees centigrade, aniline point from 50 to 80 degrees centigrade, vapor density of 3.5 to 6.0 (air being 1) and viscosity (cps. 25 degrees centigrade) from 0.70 to 1.75. This is sometimes employed as a cleaning solvent to clean components within a fuel system.

Working in combination, the foregoing ingredients achieve the desired affect of cleaning of protecting the golf club face when applied thereto, and, when applied to the grips, restoring the grips to a "new" feel.

Other Ingredients

OPT Synthetic Calcium Sulfonates: Over-based calcium sulfonates with a TBN of 100 to 600 whose primary purpose is for extreme pressure additive formulations offering corrosion protection, dispersants and detergency in oil soluble additives for ferrous and non-ferrous metals with a minimum calcium weight of 10.00 to 20.00%, a total base number, mg KOH/g (ASTM D-2896) of 100 to 600 and an average molecular weight (ASTM D-3712) of 800 to 1200.

Methyl-Isobutyl Ketones (MIBK): Formula C6H12) CAS 108-10-1, Flammable Liquid. MIBK is general used a as solvent for vinyl, epoxy, acrylic and natural resins, nitrocellulose, paints, varnishes, lacquers, protective coatings, rare metal extractions and dyes. Further they are commonly used in manufacturing antibiotics, dry-cleaning preparation and the synthesis of methyl isobutyl carbinol. MIBK occurs naturally in oranges, grapes and vinegar. It is colorless, has a low boiling point, and is miscible in proportions with water, alcohols, most hydrocarbons and other organic liquids. MIBK has a flash point of 14 degrees centigrade. MIBK is manufactured from acetones via a three-step process involving dimerised alcohol condensation to diacetone alcohol. Further diacetones readily hydrate to give mesityl oxides. Mesityl oxides can then be hydrogenated to MIBK. MIBK is used as a denaturing agent for denatured alcohols and as such lends itself a quick drying agent, necessary to conform to the Rules of Golf.

Solvent-Activated Fragrance: Alcohol-concentrated fragrance essence with an HA (Hyaluronate) or NAHA (Sodium hyaluronate) of 0.005% to 1%. The active ingredient resists bacterial growth and contains a molecular encapulant (fixative) to maintain the selective fragrance use to mask the chemical odor of certain compounds.

Solvent-Activated dyes: An alcohol (NAHA) solution of polymer color forming compounds. These are commonly used to identify grades or designated uses of fuels and lubricants. They are produced in both powder and liquid form and when introduced to the product are stable and leave an identifiable color to the product.

Polytetrafluoroethylene (fluoroadditive): CAS No 9002-84-0. Fluoroadditives are organic polymers in colloidal form that when blended into a solvent base compound and applied are highly resistant to water or weathering conditions.

Each of the foregoing ingredients further improves the overall performance of the product for cleaning and protecting the clubface, and restoring the grips.

Preferred Blending Ratios

The preferred blending Ratios for each component are shown as below. It is important to maintain a blend of components that falls within the following percentages. Note that in the event one or more of the ingredients shown below is omitted from the golf club cleaner and protectant, the percentages by weight of the remaining ingredients are proportionately increased:

Alpha-Olefins: 5 to 30% by weight and preferably 7.0 to 25% by weight and more preferably 9.0 to 18% by weight. Most preferable is 13.5% by weight.

Low-Odor Aromatic Solvents: 2 to 25% by weight and preferably 4.5 to 18% by weight and more preferably 7 to 14% by weight. Most preferable is 9.4% by weight.

Hydroisomerized High-Base Oils or HT Severe Hydrocracked Base Oils: 7 to 35% by weight and preferably 10 to 32% by weight and more preferably 15 to 30% by weight. Most preferable is 26.5% by weight.

Low-Flash Mineral Spirits: 15 to 60% by weight and preferably 20 to 55% by weight and more preferably 25 to 49% by weight. Most preferable is 40% by weight.

Synthetic Calcium Sulfonates: 0.05 to 1.25% by weight, preferably 0.20 to 0.97% by weight and more preferably 0.40 to 0.72% by weight. Most preferable is 0.625% by weight.

Methyl-Isobutyl Ketones: 3.0 to 25% by weight and preferably 5 to 20% by weight and more preferably 7 to 16% by weight. Most preferable is 10% by weight.

Solvent-Activated Fragrance: 0.001 to 0.005% by weight and preferably 0.0015 to 0.004% and more preferably 0.00175 to 0.003% by weight. Most preferable is 0.002% by weight.

Solvent-Activated Dyes: 0.002 to 0.005% by weight and preferably 0.0025 to 0.004% by weight and more preferably 0.027 to 0.035% by weight. Most preferable is 0.003% by weight.

Polytetrafluoroethylene (fluoroadditive): 0.012 to 0.097% by weight and preferably 0.022 to 0.0825% and more preferably 0.042 to 0.071% by weight. Most preferable is 0.0625% by weight.

Preferred Sequence of Blending Components

The initial blend (primary blend) will require the Poly Alpha Olefins, the Low Aromatic Solvent and the Base Oil being blended until the liquid is a consistent amalgamation without any appearance of separation. Blending is based on speed of the agitator and temperature will dictate the amount of time for the blend to complete. The blending time range may vary from 4 to 6 hours. The ideal temperature for each component is between 22 to 30 degrees centigrade for ideal blending. While this is blending, a secondary blend for the Methyl Isobutyl Ketones, Solvent-Activated Fragrance and Solvent-Activated Dyes is prepared in a much smaller high speed enclosed blender, and then added to the main blend.

The mineral spirits will be blended with the Synthetic Calcium Sulfonates in an approximate 70/30 ratio in the initial stage of the blend to produce a tertiary blend. (The mineral spirits used will be from the preferred percentage set forth earlier.) This tertiary blend, or the mineral spirits alone absent the synthetic calcium sulfonates, together with the balance of the ingredients, can be then added to the primary blend and the agitator is run until the components appear to have thoroughly blended into a consistent liquid.

Preferred Blend Equipment

The Process sequence involves a series of blending and holding tanks where the product can be weighed and then pumped through control valves to maintain consistent flow and pressure. The blending should be performed in an enclosed tank to reduce product evaporation (loss) and prevent exposure to open spark. Blending equipment can be by a combination of high or low speed blending apparatus. Size or volume of tank is not critical to the blend.

Universal Use of Invention

The product has been submitted to the USGA and the Royal and the R&A Golf Association for evaluation under confidential terms, to determine its allowance according to the rules of Golf when applied according to specific directions of use. Both the USGA and R&A Golf Association have determined the product is "Permitted Under the Rules of Golf" and "Allowable under the Rules of Golf," (USGA Decision 2007-46) and "Conforms to the Rules of Golf," (R&A Decision Reference #ES2007-0841). The invention when applied to the clubface has demonstrated soil repellency, weather/water resistance and ease of cleaning.

Experimental Testing Procedures

As the product is unique to the field of golf, there are limited methods to experimentally test the effect of the product on the club other than actual testing on the golf course or the driving range. Samples of the product have been put to test with remarkable results demonstrating consistently-increased distances brought about by reduced sidespin and increased backspin.

Experimental Test Results

As there are no known ASTM-D test protocols to measure results, the inventor has had to rely on actual results of golfing and driving balls on the range. Along with the decision by the USGA and the R&A Golf Association, the results have demonstrated a positive impact the product can and will have on lowering golf scores.

This experimental testing has demonstrated the ability of the invention to dramatically reduce negative sidespin that is currently being experienced by the majority of golfers today.

While only certain preferred features of the invention have been illustrated and described, many modifications, changes and substitutions will occur to those skilled in the art. It is, therefore, to be understood that the appended claims are intended to cover all such modifications and changes as fall within the true spirit of the invention.

I claim:

1. A synthetic golf club cleaner and protectant, comprising:
alpha-olefins;
low-odor aromatic solvents; and
at least one base oil selected from the base oil group consisting of hydroisomerized high base oils and HT severe hydrocracked base oils; wherein:
said alpha-olefins comprise from 5 to 30 percent thereof, by weight;
said low-odor aromatic solvents comprise from 2 to 25 percent thereof, by weight;
said at least one base oil comprises from 7 to 35 percent thereof, by weight; and
said percentages by weight are specified in relative proportion to one another.

2. The synthetic golf club cleaner and protectant of claim 1, further comprising:
low-flash mineral spirits which have been subjected to hydrodesulfurization.

3. The synthetic golf club cleaner and protectant of claim 2, further comprising:
calcium sulfonates.

4. The synthetic golf club cleaner and protectant of claim 2, further comprising:
methyl-isobutyl ketones; and
solvent-activated fragrance.

5. The synthetic golf club cleaner and protectant of claim 4, further comprising:
solvent-activated dyes.

6. The synthetic golf club cleaner and protectant of claim 3, further comprising:
methyl-isobutyl ketones; and
solvent-activated fragrance.

7. The synthetic golf club cleaner and protectant of claim 6, further comprising:
solvent-activated dyes.

8. The synthetic golf club cleaner and protectant of claim 4, further comprising:
at least one fluoroadditive.

9. The synthetic golf club cleaner and protectant of claim 5, further comprising:
at least one fluoroadditive.

10. The synthetic golf club cleaner and protectant of claim 6, further comprising:
at least one fluoroadditive.

11. The synthetic golf club cleaner and protectant of claim 7, further comprising:
at least one fluoroadditive.

12. The synthetic golf club cleaner and protectant of claim 5:
said solvent-activated dyes comprising an alcohol solution of polymer color forming compounds leaving an identifiable color to said cleaner and protectant; and
said solvent-activated fragrance comprising an alcohol fragrance essence solution.

13. The synthetic golf club cleaner and protectant of claim 7:
said solvent-activated dyes comprising an alcohol solution of polymer color forming compounds leaving an identifiable color to said cleaner and protectant; and
said solvent-activated fragrance comprising an alcohol fragrance essence solution.

14. The synthetic golf club cleaner and protectant of claim 2:
said alpha-olefins comprising from 5 to 30 percent thereof, by weight;
said low-odor aromatic solvents comprising from 2 to 25 percent thereof, by weight;
said at least one base oil comprising from 7 to 35 percent thereof, by weight; and
said low-flash mineral spirits comprising 15 to 60 percent thereof, by weight.

15. The synthetic golf club cleaner and protectant of claim 3:
said alpha-olefins comprising from 5 to 30 percent thereof, by weight;
said low-odor aromatic solvents comprising from 2 to 25 percent thereof, by weight;
said at least one base oil comprising from 7 to 35 percent thereof, by weight;
said low-flash mineral spirits comprising 15 to 60 percent thereof, by weight; and
said calcium sulfonates comprising 0.05 to 1.25 percent thereof, by weight.

16. The synthetic golf club cleaner and protectant of claim 4:
said alpha-olefins comprising from 5 to 30 percent thereof, by weight;
said low-odor aromatic solvents comprising from 2 to 25 percent thereof, by weight;
said at least one base oil comprising from 7 to 35 percent thereof, by weight; and
said low-flash mineral spirits comprising 15 to 60 percent thereof, by weight;
said methyl-isobutyl ketones comprising 3.0 to 25 percent thereof, by weight; and
said solvent-activated fragrance comprising 0.001 to 0.005 percent thereof, by weight.

17. The synthetic golf club cleaner and protectant of claim 5:
said alpha-olefins comprising from 5 to 30 percent thereof, by weight;
said low-odor aromatic solvents comprising from 2 to 25 percent thereof, by weight;
said at least one base oil comprising from 7 to 35 percent thereof, by weight; and said low-flash mineral spirits comprising 15 to 60 percent thereof, by weight;

said methyl-isobutyl ketones comprising 3.0 to 25 percent thereof, by weight;

said solvent-activated fragrance comprising 0.001 to 0.005 percent thereof, by weight; and said solvent-activated dyes comprising 0.002 to 0.005 percent thereof, by weight.

18. The synthetic golf club cleaner and protectant of claim 6:

said alpha-olefins comprising from 5 to 30 percent thereof, by weight;

said low-odor aromatic solvents comprising from 2 to 25 percent thereof, by weight;

said at least one base oil comprising from 7 to 35 percent thereof, by weight;

said low-flash mineral spirits comprising 15 to 60 percent thereof, by weight;

said calcium sulfonates comprising 0.05 to 1.25 percent thereof, by weight;

said methyl-isobutyl ketones comprising 3.0 to 25 percent thereof, by weight; and said solvent-activated fragrance comprising 0.001 to 0.005 percent thereof, by weight.

19. The synthetic golf club cleaner and protectant of claim 7:

said alpha-olefins comprising from 5 to 30 percent thereof, by weight;

said low-odor aromatic solvents comprising from 2 to 25 percent thereof, by weight;

said at least one base oil comprising from 7 to 35 percent thereof, by weight;

said low-flash mineral spirits comprising 15 to 60 percent thereof, by weight;

said calcium sulfonates comprising 0.05 to 1.25 percent thereof, by weight;

said methyl-isobutyl ketones comprising 3.0 to 25 percent thereof, by weight;

said solvent-activated fragrance comprising 0.001 to 0.005 percent thereof, by weight; and said solvent-activated dyes comprising 0.002 to 0.005 percent thereof, by weight.

20. The synthetic golf club cleaner and protectant of claim 8:

said alpha-olefins comprising from 5 to 30 percent thereof, by weight;

said low-odor aromatic solvents comprising from 2 to 25 percent thereof, by weight;

said at least one base oil comprising from 7 to 35 percent thereof, by weight; and said low-flash mineral spirits comprising 15 to 60 percent thereof, by weight;

said methyl-isobutyl ketones comprising 3.0 to 25 percent thereof, by weight; and said solvent-activated fragrance comprising 0.001 to 0.005 percent thereof, by weight; and said at least one fluoroadditive comprising 0.012 to 0.097 percent thereof, by weight.

21. The synthetic golf club cleaner and protectant of claim 9:

said alpha-olefins comprising from 5 to 30 percent thereof, by weight;

said low-odor aromatic solvents comprising from 2 to 25 percent thereof, by weight;

said at least one base oil comprising from 7 to 35 percent thereof, by weight; and said low-flash mineral spirits comprising 15 to 60 percent thereof, by weight;

said methyl-isobutyl ketones comprising 3.0 to 25 percent thereof, by weight;

said solvent-activated fragrance comprising 0.001 to 0.005 percent thereof, by weight;

said solvent-activated dyes comprising 0.002 to 0.005 percent thereof, by weight; and said at least one fluoroadditive comprising 0.012 to 0.097 percent thereof, by weight.

22. The synthetic golf club cleaner and protectant of claim 10:

said alpha-olefins comprising from 5 to 30 percent thereof, by weight;

said low-odor aromatic solvents comprising from 2 to 25 percent thereof, by weight;

said at least one base oil comprising from 7 to 35 percent thereof, by weight;

said low-flash mineral spirits comprising 15 to 60 percent thereof, by weight;

said calcium sulfonates comprising 0.05 to 1.25 percent thereof, by weight;

said methyl-isobutyl ketones comprising 3.0 to 25 percent thereof, by weight;

said solvent-activated fragrance comprising 0.001 to 0.005 percent thereof, by weight; and said at least one fluoroadditive comprising 0.012 to 0.097 percent thereof, by weight.

23. The synthetic golf club cleaner and protectant of claim 11:

said alpha-olefins comprising from 5 to 30 percent thereof, by weight;

said low-odor aromatic solvents comprising from 2 to 25 percent thereof, by weight;

said at least one base oil comprising from 7 to 35 percent thereof, by weight;

said low-flash mineral spirits comprising 15 to 60 percent thereof, by weight;

said calcium sulfonates comprising 0.05 to 1.25 percent thereof, by weight;

said methyl-isobutyl ketones comprising 3.0 to 25 percent thereof, by weight;

said solvent-activated fragrance comprising 0.001 to 0.005 percent thereof, by weight;

said solvent-activated dyes comprising 0.002 to 0.005 percent thereof, by weight; and said at least one fluoroadditive comprising 0.012 to 0.097 percent thereof, by weight.

24. The synthetic golf club cleaner and protectant of claim 2, produced by a method comprising:

blending said alpha-olefins, said low-odor aromatic solvents, and said at least one base oil until the blend is a consistent amalgamation without any appearance of separation, thereby producing a primary blend; and adding said mineral spirits to said primary blend.

25. The synthetic golf club cleaner and protectant of claim 3, produced by a method comprising:

blending said alpha-olefins, said low-odor aromatic solvents, and said at least one base oil until the blend is a consistent amalgamation without any appearance of separation, thereby producing a primary blend;

separately blending said mineral spirits and said calcium sulfonates, thereby producing a tertiary blend; and adding said tertiary blend to said primary blend.

26. The synthetic golf club cleaner and protectant of claim 4, produced by a method comprising:

blending said alpha-olefins, said low-odor aromatic solvents, and said at least one base oil until the blend is a consistent amalgamation without any appearance of separation, thereby producing a primary blend;

separately blending said methyl-isobutyl ketones and said solvent-activated fragrance, thereby producing a secondary blend; and adding said secondary blend and said mineral spirits to said primary blend.

27. The synthetic golf club cleaner and protectant of claim 5, produced by a method comprising:

blending said alpha-olefins, said low-odor aromatic solvents, and said at least one base oil until the blend is a consistent amalgamation without any appearance of separation, thereby producing a primary blend;

separately blending said methyl-isobutyl ketones, said solvent-activated fragrance, and said solvent-activated dyes, thereby producing a secondary blend; and adding said secondary blend and said mineral spirits to said primary blend.

28. The synthetic golf club cleaner and protectant of claim 6, produced by a method comprising:

blending said alpha-olefins, said low-odor aromatic solvents, and said at least one base oil until the blend is a consistent amalgamation without any appearance of separation, thereby producing a primary blend;

separately blending said methyl-isobutyl ketones and said solvent-activated fragrance, thereby producing a secondary blend;

separately blending said mineral spirits and said calcium sulfonates, thereby producing a tertiary blend; and adding said secondary and tertiary blends to said primary blend.

29. The synthetic golf club cleaner and protectant of claim 7, produced by a method comprising:

blending said alpha-olefins, said low-odor aromatic solvents, and said at least one base oil until the blend is a consistent amalgamation without any appearance of separation, thereby producing a primary blend;

separately blending said methyl-isobutyl ketones, said solvent-activated fragrance, and said solvent-activated dyes, thereby producing a secondary blend;

separately blending said mineral spirits and said calcium sulfonates, thereby producing a tertiary blend; and adding said secondary and tertiary blends to said primary blend.

30. The synthetic golf club cleaner and protectant of claim 8, produced by a method comprising:

blending said alpha-olefins, said low-odor aromatic solvents, and said at least one base oil until the blend is a consistent amalgamation without any appearance of separation, thereby producing a primary blend;

separately blending said methyl-isobutyl ketones, said solvent-activated fragrance, and said at least one fluoroadditive, thereby producing a secondary blend; and adding said secondary blend and said mineral spirits to said primary blend.

31. The synthetic golf club cleaner and protectant of claim 9, produced by a method comprising:

blending said alpha-olefins, said low-odor aromatic solvents, and said at least one base oil until the blend is a consistent amalgamation without any appearance of separation, thereby producing a primary blend;

separately blending said methyl-isobutyl ketones, said solvent-activated fragrance, said solvent-activated dyes, and said at least one fluoroadditive, thereby producing a secondary blend; and adding said secondary blend and said mineral spirits to said primary blend.

32. The synthetic golf club cleaner and protectant of claim 10, produced by a method comprising:

blending said alpha-olefins, said low-odor aromatic solvents, and said at least one base oil until the blend is a consistent amalgamation without any appearance of separation, thereby producing a primary blend;

separately blending said methyl-isobutyl ketones, said solvent-activated fragrance, and said at least one fluoroadditive, thereby producing a secondary blend;

separately blending said mineral spirits and said calcium sulfonates, thereby producing a tertiary blend; and adding said secondary and tertiary blends to said primary blend.

33. The synthetic golf club cleaner and protectant of claim 11, produced by a method comprising:

blending said alpha-olefins, said low-odor aromatic solvents, and said at least one base oil until the blend is a consistent amalgamation without any appearance of separation, thereby producing a primary blend;

separately blending said methyl-isobutyl ketones, said solvent-activated fragrance, said solvent-activated dyes, and said at least one fluoroadditive, thereby producing a secondary blend;

separately blending said mineral spirits and said calcium sulfonates, thereby producing a tertiary blend; and adding said secondary and tertiary blends to said primary blend.

34. A method of producing a synthetic golf club cleaner and protectant, comprising:

blending alpha-olefins, low-odor aromatic solvents, and at least one base oil until the blend is a consistent amalgamation without any appearance of separation, thereby producing a primary blend; and adding mineral spirits which have been subjected to hydrodesulfurization, to said primary blend.

35. The method of claim 34, further comprising:

separately blending said mineral spirits and calcium sulfonates, thereby producing a tertiary blend; and adding said tertiary blend to said primary blend.

36. The method of claim 34, further comprising:

separately blending methyl-isobutyl ketones and solvent-activated fragrance, thereby producing a secondary blend; and adding said secondary blend and mineral spirits to said primary blend.

37. The method of claim 34, further comprising:

separately blending methyl-isobutyl ketones, solvent-activated fragrance, and solvent-activated dyes, thereby producing a secondary blend; and adding said secondary blend and said mineral spirits to said primary blend.

38. The method of claim 36, further comprising:

separately blending said mineral spirits and said calcium sulfonates, thereby producing a tertiary blend; and adding said secondary and tertiary blends to said primary blend.

39. The method of claim 37, further comprising:

separately blending mineral spirits and calcium sulfonates, thereby producing a tertiary blend; and adding said secondary and tertiary blends to said primary blend.

40. The method of claim 36, comprising:

separately blending said methyl-isobutyl ketones, said solvent-activated fragrance, and said at least one fluoroadditive, thereby producing said secondary blend.

41. The method of claim 37, further comprising:

separately blending methyl-isobutyl ketones, solvent-activated fragrance, solvent-activated dyes, and at least one fluoroadditive, thereby producing said secondary blend.

42. The method of claim 38, further comprising:

separately blending methyl-isobutyl ketones, solvent-activated fragrance, and at least one fluoroadditive, thereby producing said secondary blend.

43. The method of claim 39, further comprising:

separately blending methyl-isobutyl ketones, solvent-activated fragrance, solvent-activated dyes, and at least one fluoroadditive, thereby producing said secondary blend.

* * * * *